United States Patent [19]

Mahoney, Jr.

[11] Patent Number: 4,869,594

[45] Date of Patent: Sep. 26, 1989

[54] APPARATUS AND METHOD FOR BLENDING PARTICULATE MATERIALS

[75] Inventor: William J. Mahoney, Jr., Williamsport, Pa.

[73] Assignee: Delaware Investments, Inc., Wilmington, Del.

[21] Appl. No.: 165,547

[22] Filed: Mar. 8, 1988

[51] Int. Cl.[4] ..... B01F 5/00

[52] U.S. Cl. ..... 366/341; 366/337; 366/338

[58] Field of Search ..... 366/341, 6, 9, 342, 366/336, 337, 338, 339, 101, 106, 107, 10, 14, 15

[56] References Cited

U.S. PATENT DOCUMENTS

| | | | |
|---|---|---|---|
| 829,127 | 8/1906 | Strauss | 366/336 |
| 3,051,452 | 8/1962 | Nobel | 366/337 |
| 3,195,865 | 7/1965 | Harder | 366/337 |
| 4,597,852 | 7/1986 | York | 366/337 |
| 4,629,328 | 12/1986 | Revelt | 366/341 |

*Primary Examiner*—Robert W. Jenkins
*Attorney, Agent, or Firm*—Lalos & Keegan

[57] ABSTRACT

An apparatus for blending particulate materials comprising means defining an upper chamber for holding a supply of material to be blended, the material holding means having at least one wall, the wall of the material holding means having at least two outlet ports spaced vertically and about a perimeter of the material holding means for reeiving therethrough particulate material from the upper chamber by gravity flow, means defining a lower chamber for blending particulate material, the material blending means having at least one wall, the wall of the material blending means having at least two inlet ports, means intercommunicating each of the outlet ports with one of the inlet ports for guiding material from the upper chamber to the lower chamber, flow diverting means disposed in the lower chamber, the flow diverting means having means positioned to intercept the flow of material through each of the inlet ports for dividing the flow of material into separate streams, each of the material flow intercepting means including a set of surfaces disposed in diverging relation relative to the direction of material flow.

36 Claims, 2 Drawing Sheets

APPARATUS AND METHOD FOR BLENDING PARTICULATE MATERIALS

This invention relates to an apparatus and method for blending diverse particular materials and more particularly to an apparatus and method for blending such materials by gravity flow. The invention further contemplates a novel collector device for a blending apparatus for recombining separate streams of particulate material withdrawn from an elevated mass of such material.

In the prior art, there has been developed a type of blender apparatus generally consisting of an elevated vessel defining an upper chamber in which diverse particulate materials to be blended are deposited, a lower vessel defining a lower chamber in which streams of particulate material withdrawn from the upper chamber are recombined to blend the materials, and a plurality of downcomers intercommunicating diverse points of the upper chamber with the lower chamber for guiding withdrawn material from the upper chamber to the lower chamber to provide the blending process. An example of such type of gravity flow blender is illustrated and described in U.S. Pat. No. 4,632,565. Further examples of collector devices used for recombining the streams of particulate materials are illustrated and described in U.S. Pat. Nos. 3,208,737, 3,347,534 and 3,448,968.

Ideally, in gravity type blenders of the type described, it is sought to provide optimum blending of diverse particulate materials in a single pass of the material through the apparatus. This, however, is not normally possible which results in either having to recycle the material through the apparatus to improve the quality of blend or accepting a finished product of less than an optimal blend.

It thus has been found to be desirable to provide a gravity blender of the type described in which a mass of diverse particulate material deposited in the upper chamber of the apparatus will be optimally blended in a single pass of the material through the apparatus.

Accordingly, it is the principal object of the present invention to provide an improved apparatus for blending diverse particulate materials.

Another object of the present invention is to provide an improved apparatus for blending diverse particulate materials by means of depositing the diverse particulate materials in an upper chamber, withdrawing such deposit of material from diverse points by gravity flow and recombining streams of withdrawn material in a lower chamber.

A further object of the present invention is to provide an improved gravity flow type blending apparatus in which the materials are blended in a single pass through the apparatus.

A still further object of the present invention is to provide an improved gravity flow type blender in which the material is blended in a single pass through the apparatus and optimal blending of the material is achieved.

Another object of the present invention is to provide an improved collector device for a gravity flow type blending apparatus.

A further object of the present invention is to provide an improved collector device for a gravity flow type blending apparatus which functions not only to recombine a numer of streams of material withdrawn from an upper chamber but to enhance the blending action of the apparatus.

A still further object of the present invention is to provide an improved method of blending diverse particulate materials.

Another object of the present invention is to provide an improved gravity flow type blending apparatus which is simple in construction, comparatively inexpensive to manufacture and highly effective in performance.

Other objects and advantages of the present invention will become more apparent to those persons having ordinary skill in the art to which the present invention pertains from the following description taken in conjunction with the accompanying drawings in which.

Figure 1:
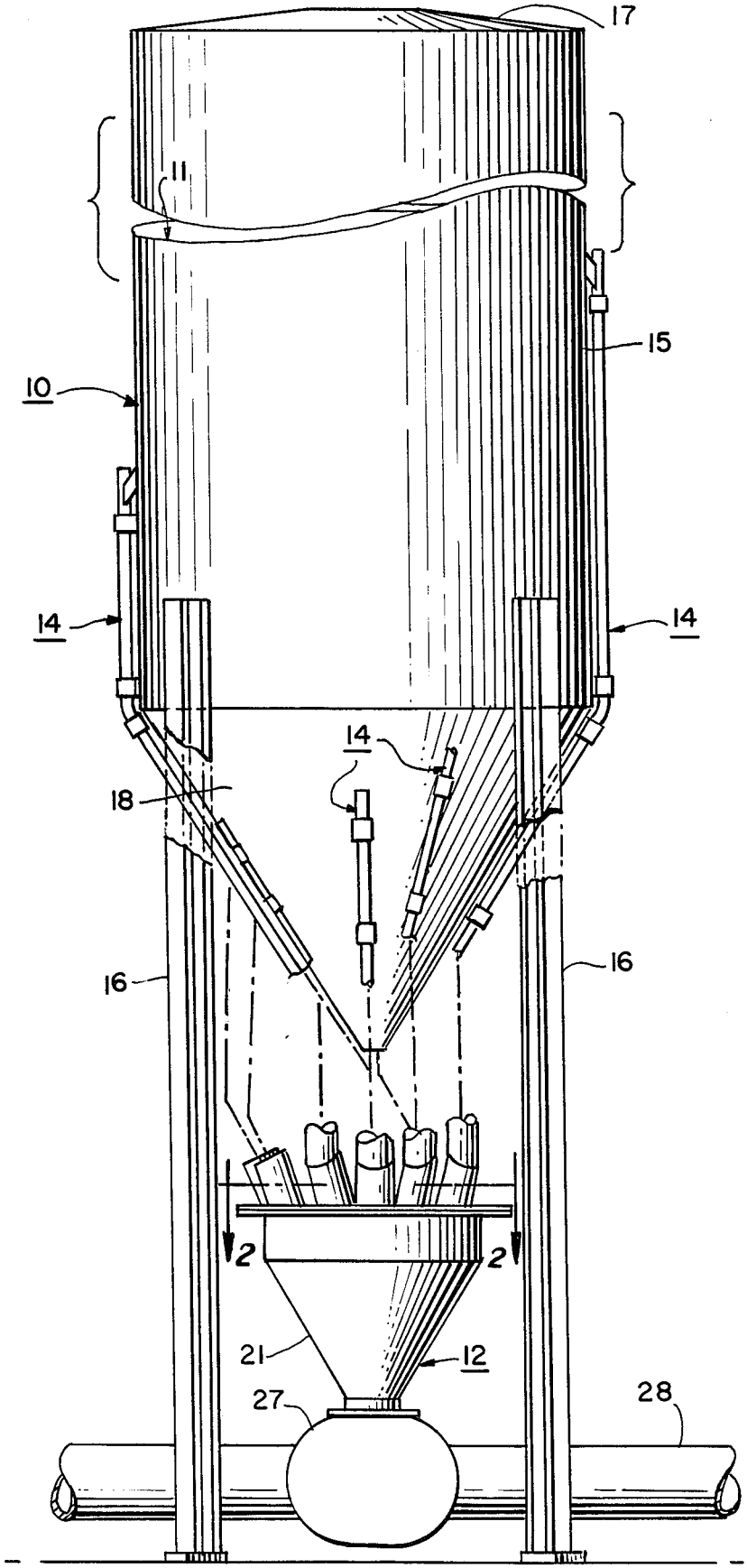
FIG. 1 is a side elevational view of an embodiment of the invention.
Figure 2:
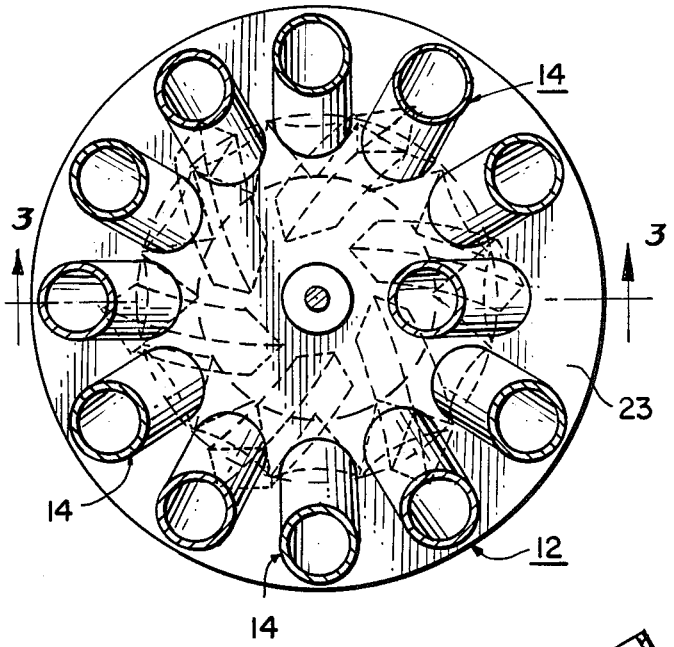
FIG. 2 is an enlarged cross-sectional view taken along line 2—2 in FIG. 1.

The embodiment of the invention illustrated in the drawings generally consists of an elevated vessel 10 defining an upper chamber 11, a lower vessel or collector device 12 defining a lower chamber 13 and a plurality of downcomers 14. The elevated vessel includes a vertically disposed cylindrical wall 15 supported on a set of structural members 16 a top wall 17 and a lower, inverted conical wall 18. Top wall 17 is provided with an access door or connecting device for depositing diverse particulate materials to be blended in vessel 10. The material may simply be dumped mechanically or manually through an access opening in the elevated vessel or may be supplied thereto by means of a pneumatic conveying system.

Collector device 12 generally includes an upper cylindrical wall section 19 a lower cylindrical wall section 20 and an intermediate, inverted conical wall section 21. Cylindrical wall section 19 is provided with an upper annual flange 22 which supports a cylindrical cover plate 23 to close the upper end of chamber 13. The cover plate may be secured to annual flange 22 by a set a bolts or may be welded thereto depending on the particular application. It further is provided with a plurality of circumferentially spaced inlet ports 24 which communicate with the lower ends of downcomers 14. Lower cylindrical section 20 defines an outlet port 25 and is provided with a mounting flange 26 for securing the collector device to a valve 27 as best shown in FIG. 1. Valve 27 controls the flow of material from the collector device through outlet 25 to a pneumatic conveying conduit 28.

The upper ends of downcomers 14 are connected to vessel walls 15 and 18 and communicate with the interiors thereof at a plurality of points spaced vertically and about the permeter of vessel 10. Such downcomers function to withdraw material from upper chamber 11 by gravity flow and guide such material downwardly and through inlet ports 24 into lower chamber 13.

Figure 3:
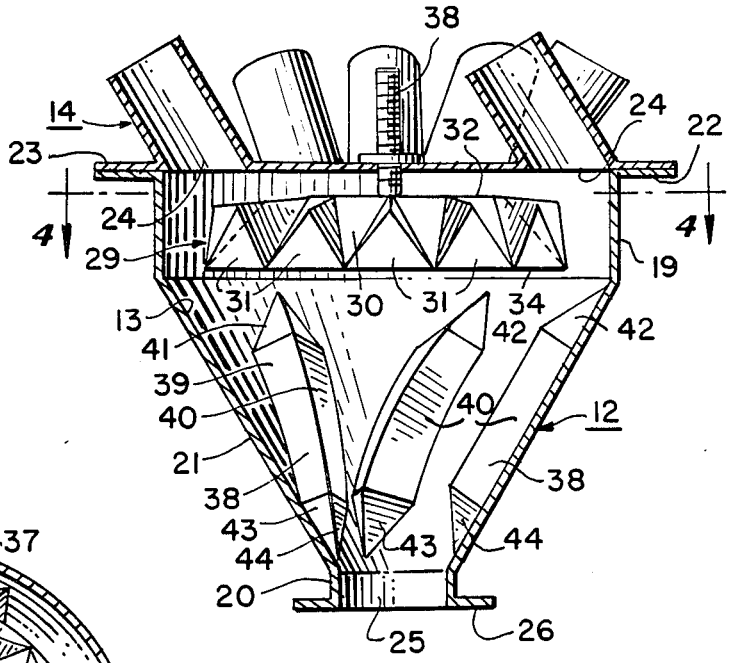
FIG. 3 is a cross-sectional view taken along line 3—3 in FIG. 2.
Figure 4:
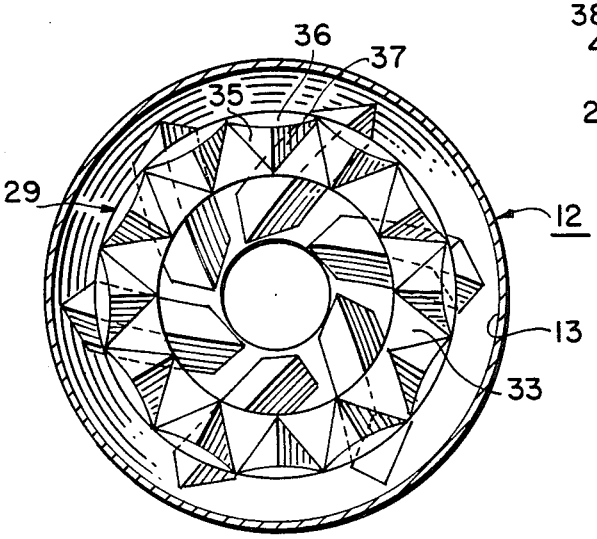
FIG. 4 is a cross-sectional view taken along line 4—4 in FIG. 3.

Disposed in the upper end of lower chamber 13 between inlet ports 24 and outlet port 25 is a flow diverting member 29. As best seen in FIGS. 3 and 4, the flow diverting member includes a frusto-conically configured section 30 and a plurality of flow dividing and diverting elements 31. The frusto-conically shaped section of the flow diverting member includes an upper wall 32, a side wall 33 and a bottom wall 34. The dividing and diverting elements 31 are mounted on side wall 33 about the periphery thereof. Each of elements 31 consists of a polyhedron having for its base a polygon and for faces triangles with a common vertex. In the embodiment shown in the drawings, elements 31 are provided with a triangle base mounted on side wall 33 and triangular sides 35, 36 and 37. Each of elements 31 is adapted to register or align with an inlet port 24 so that a stream of particulate material introduced into chamber 13 through a downcomer 14 will impinge on the walls of an element 31 to be divided into separate streams and diverted to enhance the blending action of the collector device.

The diverter member is supported within the collector device

In the operation of the embodiment of the invention as described, whenever it is desired to blend two or more diverse particulate materials, the apparatus may be readied by operating threaded member 38 to lower flow diverting member 29 to its lowermost position thus providing a restricted annular spacing between the lower edge of flow diverting member 29 and conical wall section 21. With the flow diverting member thus positioned, the diverse particulate materials to be blended are deposited in upper chamber 11 either by mechanically or manually depositing the material through an access opening in top wall 17 of vessel 10 or conveying such material thereto by means of a pneumatic conveying system. As the material fills chamber 11, it will gravity flow through conduits 14 and inlet ports 24 of the collector device into the upper end of chamber 13. Flow of the material through the collector device initially will be prevented or impeded by flow diverting member 29 and/or bridging of the material between the flow diverting member and the side wall of the collector device. After the upper chamber has been filled with the material and the blending operation is to be commenced, the flow diverting member is displaced upwardly by turning threaded member 38 to increase the width of the annular spacing between the flow diverting member and the side walls of the collector device to allow material to flow therebetween. As the material gravity flows through downcomers 14 and inlet ports 24 it will impinge upon elements 31 causing the incoming streams of material to divide and be diverted within chamber 13. Such by means of an axially disposed threaded member 38. Member 38 is threaded through an axially disposed opening in cover plate 23 and is operatively connected at its lower end to the diverter member. The upper end of member 38 is provided with a handle (not shown) which may be operated manually to turn the threaded member and correspondingly displace the diverter member axially within chamber 13. It will be appreciated that by displacing adjusting the diverter member axially within chamber 13, the lower peripheral edge of the diverter member will cooperate with conical wall 21 of the collector device to vary the width of the annular opening therebetween to provide valving of the material introduced into the collector device through inlet ports 24 and discharged therefrom through outlet port 25.

The blending of particulate matter introduced into chamber 13 is further enhanced by means of a plurality of secondary dividing and diverting elements 39 circumferentially spaced and mounted on the inner side of conical wall section 21. Each of elements 38 generally have a helical configuration and a wedge shaped cross-sectional configuration providing a pair of angularly disposed surfaces 39 and 40. The upper end of each elements 38 is provided with a pair of converging, triangular surfaces 41 and 42 and each of the lower ends thereof is provided with a similar set of converging, triangular surfaces 43 and 44 which further function to divide and divert streams of material within chamber 13 to even further enhance the blending action of the collector device. divided and diverted streams will further be caused to impinge upon elements 38 and be further divided and diverted by means of impinging upon the angular walls thereof and also to swirl within the lower portion of chamber 13 as a result of the general helical configuration of each of elements 38. At the lower end of chamber 13, the material is discharged through outlet port 25 and through valve 27 into conduit 28 to be conveyed to a desired destination.

It will be appreciated that as a plurality of separate streams of diverse particulate material is gravity fed through ports 24 of the collector device, such streams of material initially will be divided and diverted by elements 34 and then subsequently further divided and diverted by means of element 38. In addition, the general helical configurations of elements 38 further enhances the blending action by causing the streams of material in the lower end of chamber 13 to swirl.

Whenever it is desired to change the discharge rate of the collector device, this may be accomplished merely by vertically adjusting the position of flow diverting member 29. If it is desired to terminate the blending process, the flow diverting member may be displaced to its lowermost position to restrict flow of material through the collector device. The collector device may be formed so that flow diverting member may be lowered to a point where it physically engages conical wall section 21 or is disposed adjacent thereto to cause material introduced into the collector device to bridge the annular spacing between the flow diverting member and the cylindrical wall section to preclude the flow of material through the collector device.

The upper material holding vessel, the collector device and the downcomers may be constructed of any material having suitable strength characteristics including carbon steel, stainless steel and aluminum. Flow diverting member 29 and elements 31 and 38 similarly may be constructed of any suitable materials including carbon steel, carbon steel with an epoxy coating, aluminum and stainless steel. It is preferred that elements 31 be welded on the flow diverting member and elements 38 be welded to conical wall section 21 by continuous welds to aid the cleanability of the collector device. Where the apparatus is to be used in the blending of food stuffs, reactant chemicals or materials requiring a high degree of sanitation, it is preferred that all of the components of the apparatus be constructed of stainless steel.

The configuration as well as the locations of elements 31 and 38 in the collector device cooperates to provide a product with a higher degree of homogeneity. They further offer very little obstruction to flow. The smooth, streamline contours of elements 38 avoid material hang-up, plugging and impaired performance.

From the foregoing detailed description, it will be evident that there are a number of changes, adaptations and modifications of the present invention which come within the province of those persons having ordinary skill in the art to which the aforementioned invention pertains. However, it is intended that all such variations not departing from the spirit of the invention be considered as within the scope thereof as limited solely by the appended claims.

I claim:

1. An apparatus for blending particulate materials comprising means defining an upper chamber for holding a supply of material to be blended, said material holding means having at least one wall, said wall of said material holding means having at least two outlet ports spaced vertically and about a perimeter of said material holding means for receiving therethrough particulate material from said upper chamber by gravity flow, means defining a lower chamber for blending particulate material, said material blending means having at least one wall, said wall of said blending means having at least two inlet ports, means intercommunicating each of said outlet ports with one of said inlet ports for guiding material from said upper chamber to said lower chamber, flow diverting means disposed in said lower chamber, said flow diverting means having means positioned to intercept the flow of material through each of said inlet ports for dividing said flow of material into separate streams, each of said material flow intercepting means including a set of surfaces disposed in diverging relation relative to the direction of material flow.

2. An apparatus according to claim 1 wherein said diverging surfaces intersect to form a wedge shaped section.

3. An apparatus according to claim 2 wherein the planes of said diverting surfaces intersect and an acute angle.

4. An apparatus according to claim 1 wherein said material blending means includes an outlet port and said flow diverting means is disposed between said inlet and outlet ports thereof.

5. An apparatus according to claim 1 wherein said inlet ports are spaced circumferentially.

6. An apparatus according to claim 1 wherein said material blending means includes an upper wall and said inlet ports are disposed in said upper wall.

7. An apparatus according to claim 6 wherein said ports are spaced circumferentially.

8. An apparatus according to claim 1 wherein said flow diverting means is displaceable toward and away from said inlet ports.

9. An apparatus according to claim 1 including second flow diverting means disposed in said lower chamber.

10. An apparatus according to claim 9 wherein said second flow diverting means includes means positioned to intercept streams of divided material from said first mentioned flow diverting means for further dividing said flow of divided material into further divided streams.

11. An apparatus according to claim 1 wherein said material blending means includes an inverted frusto-conical wall section and said flow diverting means is disposed between said inlet ports and said frusto-conical wall section.

12. An apparatus according to claim 11 wherein said flow diverting means is displaceable axially relative to said frusto-conical wall section.

13. An apparatus according to claim 11 including second flow diverting means disposed in said lower chamber.

14. An apparatus according to claim 13 wherein said second flow diverting means comprises a plurality of circumferentially spaced elements disposed on said frusto-conical wall section, each of said elements having angled surfaces positioned to intercept and divide streams of divided material impinging thereon.

15. An apparatus according to claim 14 wherein each of said elements is helically configured for imparting a swirling motion to said material within said chamber.

16. A device for blending particulate materials comprising housing means defining a chamber, said housing having at least two inlet ports for gravity feeding particulate material into said chamber and an outlet port for discharging material therefrom, and flow diverting means disposed in said chamber between said inlet and outlet ports, said flow diverting means having means for intercepting the flow of material through each of said inlet ports for dividing said flow into separate streams, each of said material flow intercepting means including a set of surfaces disposed in diverging relation in the direction of material flow.

17. An apparatus according to claim 16 wherein said diverging surface intersect to form a wedge shaped section.

18. A device according to claim 17 wherein the planes of said diverging surfaces intersect at an acute angle.

19. A device according to claim 17 wherein said inlet ports are spaced circumferentially.

20. A device according to claim 17 wherein said housing includes an upper wall and said inlet ports are disposed in said upper wall.

21. An apparatus according to claim 20 wherein said ports are spaced circumferentially.

22. A device according to claim 16 wherein said flow diverting means is displaceable toward and away from said inlet ports.

23. A device according to claim 16 including second flow diverting means disposed in said chamber.

24. A device according to claim 23 wherein said second flow diverting means including means positioned to intercept streams of divided material from said mentioned flow diverting means for further dividing said flow of divided material into further divided streams.

25. A device according to claim 16 wherein said housing means includes an inverted frusto-conical wall section and said flow diverting means is disposed between said inlet ports and said frusto-conical wall section.

26. A device according to claim 25 wherein said flow diverting means is displaceable axially relative to said frusto-conical wall section.

27. A device according to claim 25 including second flow diverting means disposed in said lower chamber.

28. A device according to claim 27 wherein said second flow diverting means comprises a plurality of circumferentially spaced elements disposed on said frusto-conical wall section, each of said elements having angled surfaces positioned to intercept and divide streams of divided material impinging thereon.

29. A device according to claim 28 wherein each of said elements is helically configured for imparting a swirling motion to said material within said chamber.

30. A device for blending particulate materials comprising housing means defining a chamber having at least two inlet ports for gravity feeding particulate material into said chamber, an outlet port for discharging material therefrom and an inverted, frusto-conically shaped wall interposed between said inlet ports and said outlet port, and flow diverting means disposed in said chamber, said flow diverting means comprising a plurality of circumferentially spaced elements disposed on said frusto-conical wall, each of said elements having angled surfaces positioned to intercept and divide streams of material introduced into said chamber and impinging on said elements.

31. A device according to claim 30 wherein each of said elements is helically configured for imparting a swirling motion to said material.

32. A method of blending particulate materials comprising gravity feeding the material into a chamber having a plurality of circumferentially spaced inlet ports disposed at an upper end thereof, an outlet port disposed at a lower end thereof and an inverted, frusto-conical wall between said inlet and outlet openings, dividing and diverting the stream of material fed through each of said inlet ports, further dividing and diverting the diverted streams of material impinging upon the frusto-conical wall of said chamber, and imparting a swirling motion to said diverted streams of material impinging on said frusto-conical wall.

33. An apparatus for blending particulate materials comprising means defining a upper chamber for holding a supply of material to be blended, said material holding means having at least one wall, said wall of said material of holding material means having at least two outlet ports spaced vertically and about a perimeter of said material holding means for receiving therethrough particulate material from said upper chamber by gravity flow, means defining a lower chamber for blending particulate material, said material blending means having at least one wall, said wall of said blending means having at least two inlet ports, means intercommunicating each of said outlet ports with one of said inlet ports for guiding material from said upper chamber to said lower chamber, flow diverting means disposed in said lower chamber, said flow diverting means including means positioned to intercept the flow of material through each of said inlet ports for dividing said flow of material into separate streams, said material blending means including an inverted frusto-conical wall section, said flow diverting means being disposed between said inlet ports and said frusto-conical wall section, and second flow diverting means disposed in said lower chamber, said second flow diverting means comprising a plurality of circumferentially spaced elements disposed on said frusto-conical wall section, each of said elements having angled surfaces positioned to intercept and divide streams of divided material impinging thereon and being helically configured for imparting a swirling motion to said material within said chamber.

34. A device for blending particulate materials comprising means defining a chamber, said housing having at least two inlet ports for gravity feeding particulate material into said chamber and an outlet port for discharging material therefrom, flow diverting means disposed in said chamber between said inlet and means defining a chamber, said housing having at least outlet ports, said flow diverting means having means for intercepting the flow of material through each of said inlet ports for dividing said flow into separate streams, said housing means including an inverted frusto-conical wall section, said flow diverting means being disposed between said inlet ports and said frusto-conical wall section, and second flow diverting means disposed in said chamber, said second flow diverting means comprising a plurality of circumferentially spaced elements disposed on said frusto-conical wall section, each of said elements having angled surfaces positioned to intercept and divide streams of divided material impinging thereon and being helically configured for imparting a swirling motion to said material within said chamber.

35. A device for blending particulate materials comprising housing means defining a chamber having at least two inlet ports for gravity feeding particulate material into said chamber, an outlet port for discharging material therefrom and an inverted, frusto-conically shaped wall interposed between said inlet ports and said outlet port, and flow diverting means disposed in said chamber, said flow diverting means comprising a plurality of circumferentially spaced elements disposed on said frusto-conical wall, each of said elements having angled surfaces positioned to intercept and divide streams of material introduced into said chamber and impinging on said elements, and being helically configured for imparting a swirling motion to said material.

36. A method of blending particulate materials comprising gravity feeding the material into a chamber having a plurality of circumferentially spaced inlet ports disposed at an upper end thereof, an outlet port disposed at a lower end thereof and an inverted frusto-conical wall between said inlet and outlet openings, dividing and diverting the stream of material fed through each of said ports, and dividing and diverting the diverted streams of material impinging upon the frusto-conical wall of said chamber.

* * * * *

UNITED STATES PATENT AND TRADEMARK OFFICE

CERTIFICATE OF CORRECTION

PATENT NO. : 4,869,594

DATED : September 26, 1989

INVENTOR(S) : William J. Mahoney, Jr.

It is certified that error appears in the above-identified patent and that said Letters Patent is hereby corrected as shown below:

In Column 2, line 30, after "16" insert --,--; line 39, after "19" insert --,--;

In Column 3, the text beginning at line 47 with the words "by means of an axially" and ending at Column 4, line 9 with the words "collector device." should be transposed so as to appear in Column 3, line 16, after the words "collector device;", in Column 3, line 60, insert --a-- after "provide."

In claim 19, line 1, delete "17" and insert --16--.

In claim 20, line 1, delete "17" and insert --16--.

In claim 34, line 6, delete the words "means defining a chamber, said housing having at least".

Signed and Sealed this

Eleventh Day of September, 1990

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,869,594

DATED : 26 September 1989

INVENTOR(S) : William J. Mahoney, Jr.

It is certified that error appears in the above-identified patent and that said Letters Patent is hereby corrected as shown below:

In Column 1, line 6, delete the word "particular" and insert --particulate--; line 69, delete the word "numer" and insert --number--.

In Column 2, line 58, delete the word "permeter" and insert --perimeter--.

In Claim 3, line 2, delete "and" and insert --at--.

In Claim 17, line 2, delete "surface" and insert --surfaces--.

In Claim 24, line 2, delete "including" and insert --includes--.

Signed and Sealed this

Eighth Day of October, 1991

*Attest:*

HARRY F. MANBECK, JR.

*Attesting Officer*

*Commissioner of Patents and Trademarks*